US007905362B2

(12) United States Patent
Slimane

(10) Patent No.: US 7,905,362 B2
(45) Date of Patent: Mar. 15, 2011

(54) DISPLAY STAND FOR ARTICLES SUCH AS COSMETIC PRODUCTS

(75) Inventor: Hedi Slimane, Paris (FR)

(73) Assignee: Parfums Christian Dior, Paris (FR)

( * ) Notice: Subject to any disclaimer, the term of this patent is extended or adjusted under 35 U.S.C. 154(b) by 445 days.

(21) Appl. No.: 10/599,363

(22) PCT Filed: Mar. 25, 2005

(86) PCT No.: PCT/FR2005/000734

§ 371 (c)(1),
(2), (4) Date: Jul. 23, 2008

(87) PCT Pub. No.: WO2005/099524

PCT Pub. Date: Oct. 27, 2005

(65) Prior Publication Data

US 2008/0277538 A1 Nov. 13, 2008

(30) Foreign Application Priority Data

Mar. 30, 2004 (FR) ..... 0403327

(51) Int. Cl.
*A47F 7/00* (2006.01)

(52) U.S. Cl. ..... 211/13.1; 211/10; 211/50

(58) Field of Classification Search ..... 211/13.1, 211/60.1, 55, 40, 85.2, 41.12, 133.1, 50, 211/49.1, 41.1, 10, 134, 52, 59.2; 206/455, 206/456, 740, 538; 312/114, 118, 234, 278; 248/148, 469, 520, 536; 108/92–93
See application file for complete search history.

(56) References Cited

U.S. PATENT DOCUMENTS

| | | | | | |
|---|---|---|---|---|---|
| D27,904 | S | * | 11/1897 | Hayes | D6/471 |
| 1,361,451 | A | * | 12/1920 | Flannery, Jr. | 312/117 |
| 2,109,586 | A | * | 3/1938 | Einbinder | 359/855 |
| RE20,986 | E | * | 1/1939 | Kreisler | 220/326 |
| D134,827 | S | * | 1/1943 | Coss | D6/468 |
| 2,321,339 | A | * | 6/1943 | Wadsworth | 206/560 |

(Continued)

FOREIGN PATENT DOCUMENTS

DE 298 02 398 4/1998

(Continued)

OTHER PUBLICATIONS

French Preliminary Search Report FR 0403327; report dated Nov. 2, 2004.

(Continued)

*Primary Examiner* — Darnell M Jayne
*Assistant Examiner* — Devin Barnett
(74) *Attorney, Agent, or Firm* — Miller, Matthias & Hull, LLP

(57) ABSTRACT

The invention relates to a display stand for articles such as cosmetic products. The inventive display stand consists of a vertical board (1) comprising a rear face (4) and a front face (5). According to the invention, the front face is formed at least partially by a plurality of first panels (7) and a plurality of second panels (8) which are inclined in relation to the first panels (7), said first panels (7) being designed to receive the articles (10). Moreover, at least one of the second panels (8) is equipped with a reflective surface (8*a*) such that an image of the articles positioned on the opposing first panel (7) are visible on the second panel (8) to a person facing the board (1).

4 Claims, 1 Drawing Sheet

U.S. PATENT DOCUMENTS

| | | | | | |
|---|---|---|---|---|---|
| D155,024 | S | * | 8/1949 | Mozneck | D6/571 |
| 2,688,408 | A | * | 9/1954 | Binggely | 211/13.1 |
| 3,777,897 | A | | 12/1973 | Gray | |
| 3,908,830 | A | * | 9/1975 | Skrzelowski | 211/55 |
| 3,995,925 | A | * | 12/1976 | Roesler | 312/234 |
| D250,441 | S | * | 12/1978 | Richman et al. | D6/468 |
| 4,311,100 | A | * | 1/1982 | Gardner et al. | 108/165 |
| 4,324,446 | A | * | 4/1982 | LeSage | 312/245 |
| D276,775 | S | * | 12/1984 | Antti et al. | D6/471 |
| D283,164 | S | * | 3/1986 | Pandya | D24/230 |
| D290,534 | S | * | 6/1987 | Wendkos | D28/76 |
| D296,630 | S | * | 7/1988 | Renold et al. | D6/468 |
| D302,745 | S | * | 8/1989 | Bakic | D28/83 |
| D303,583 | S | * | 9/1989 | Bakic | D28/83 |
| 5,312,000 | A | * | 5/1994 | Bass | 211/4 |
| 6,021,784 | A | * | 2/2000 | Yuhara | 132/293 |
| 6,526,989 | B2 | * | 3/2003 | Sheffler et al. | 132/294 |
| 2002/0175166 | A1 | * | 11/2002 | Robinson et al. | 220/500 |
| 2003/0116516 | A1 | * | 6/2003 | Belokin et al. | 211/69.5 |
| 2005/0194021 | A1 | * | 9/2005 | Byun | 132/295 |

FOREIGN PATENT DOCUMENTS

| | | |
|---|---|---|
| FR | 1 566 958 | 5/1969 |

OTHER PUBLICATIONS

International Search Report PCT/FR2005/000734; report dated Aug. 3, 2005.

* cited by examiner

DISPLAY STAND FOR ARTICLES SUCH AS COSMETIC PRODUCTS

CROSS-REFERENCE TO RELATED APPLICATION

This is the US National Phase of Intetnational Application No PCT/FR2005/00734, filed Mar. 25, 2005, the entire disclosure of which is incorporated by reference.

FIELD OF THE DISCLOSURE

The present invention relates to a display stand for articles such as cosmetic products.

BACKGROUND OF THE DISCLOSURE

Known display stands generally comprise a planar display surface that may be inclined downward or be horizontal and on which the cosmetic products to be displayed to customers are arranged. However, such display stands or, more precisely, the planar display surface, cannot generally have dimensions that are too large, so as to avoid the footprint on the ground also being too large. This aspect of known display stands thus limits the number of articles that can be displayed on one and the same stand.

Furthermore, the planar display surface may also be surmounted by a mirror arranged generally vertically. However, with this known configuration, if a person wishes to ascertain the effect of the application of a color of a given cosmetic product on his or her skin, for example on his or her face, this person is necessarily obliged to take the cosmetic product from the display stand in order to bring it close to his or her face in order, by reflection in the mirror, to visualize the possible effect that the given color of the cosmetic product could have on that person's skin. This known configuration of display stands thus obliges customers constantly to handle the cosmetic products in order to bring them opposite the mirror to evaluate the possible effect that the color of said cosmetic product could have on the skin.

SUMMARY OF THE DISCLOSURE

An object of the present invention is, in particular, to palliate the abovementioned drawbacks.

To that end, according to the invention, the display stand is characterized in that it comprises a vertical board that has a rear face and a front face formed at least partially by a plurality of first panels and a plurality of second panels inclined relative to the first panels, the first and second panels being produced as a single piece together with the board, in that each first panel is interposed between two second panels and each second panel is interposed between two first panels, thereby defining a relief substantially in the form of a crest, and in that the first panels are designed to accommodate said articles, and at least one of the second panels arranged opposite one of the first panels has a reflective surface such that a person facing the board can either directly observe said articles or can observe the image of said articles reflected in the first panel placed opposite indirectly on the abovementioned second panel.

By virtue of these arrangements, the presence of the first and second panels that at least partially form the front face of the vertical board make it possible substantially to increase the number of articles to be displayed while reducing the footprint on the ground of the display stand formed solely of a vertical board.

In preferred embodiments of the invention, recourse may optionally be had, moreover, to one or other of the following arrangements:

- the second panels each have a reflective surface;
- the first and second panels extend over the entire width of the front face of the board;
- each reflective surface is formed by a flat mirror attached directly to the corresponding second panel;
- each first panel comprises a plurality of recesses in which the articles are designed to be arranged;
- a transparent plate is attached pivotably to each first panel to enable the articles arranged in the plurality of recesses to be covered;
- each first panel also has a reflective surface; and
- the board extends substantially vertically, the first panels being inclined downward and the second panels being inclined upward.

Further characteristics and advantages of the invention will become apparent in the course of the following description of an embodiment that is given by way of non-limiting example, with reference to the appended drawings.

DETAILED DESRIPTION OF THE DISCLOSURE

In the two figures, the same references denote identical or similar elements.

Figure 1:
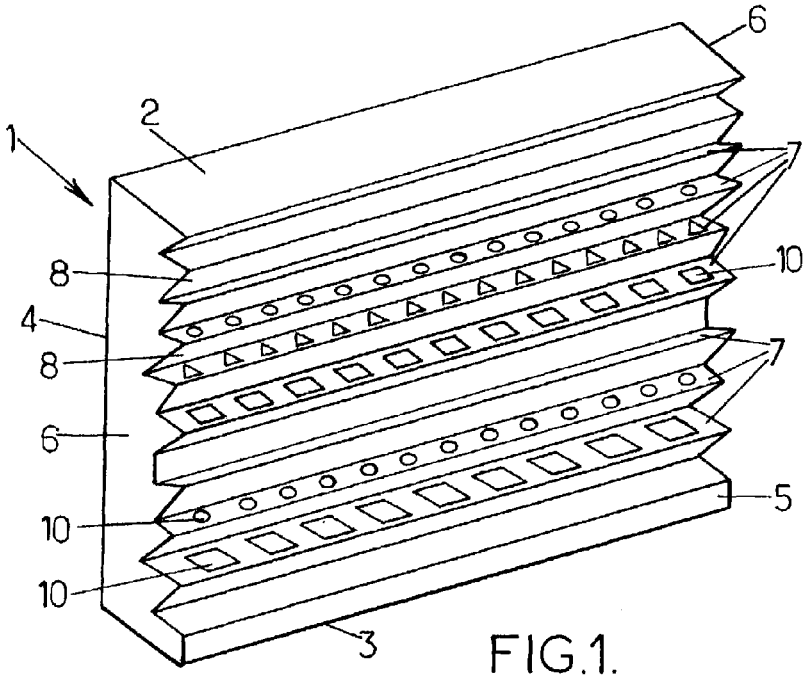
FIG. 1 shows a perspective view of the display stand according to the invention.

FIG. 1 shows a display stand 1 to which a plurality of articles 10, which may, in particular, be formed of cosmetic products, perfumes or the like, is designed to be attached.

This display stand 1 has the form of a vertical board extending vertically between an upper end 2 and a lower end 3 designed to rest directly on the ground or on any base. The display stand 1 also has a rear face 4 and a front face 5 that are defined by two lateral edges 6. The front face 5 of the vertical board 1 has, first, a plurality of first panels 7 that may be inclined downward or be horizontal, thus forming an angle of 90° with respect to the rear face 4 of the vertical board and, second, a plurality of second panels 8 that may be inclined upward or otherwise be arranged horizontally. In the example considered here, the first and second panels 7 and 8 extend over the entire width of the display stand. Nevertheless, it is also possible to envisage that said first and second panels 7 and 8 extend solely over a portion of the width of the display stand.

Each downward inclined panel 7 is interposed directly between two upward-inclined panels 8, and each upward-inclined panel 8 is interposed directly between two downward-inclined panels 7. Each panel 7 forms, with the panel 8 directly above it, an angle that is strictly less than 180° and, generally, between 90° and 30°. Thus, the downward-inclined panels 7 and the upward-inclined panels 8 form, on the front face 5 of the vertical board 1, a plurality of projecting and re-entrant dihedra, thereby defining a relief substantially in the form of a crest.

In the example considered here, each first panel 7 forms the extension of a second panel 8. However, provision may also be made for a vertical panel to be able to be arranged between first and second panels 7, 8 arranged opposite.

Figure 2:
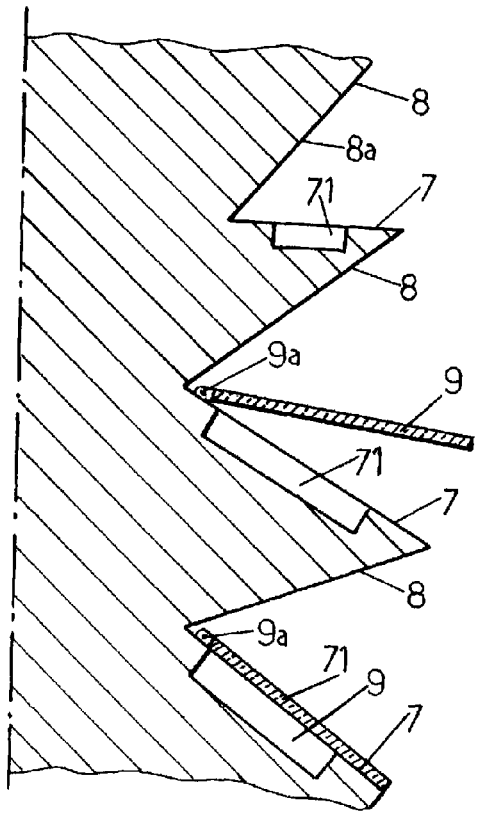
FIG. 2 shows a partial sectional view of the profile of the display stand shown in FIG. 1.

As may be seen in greater detail in FIG. 2, the panels 7 are designed to accommodate the articles 10 to be displayed to customers. To that end, each downward-inclined or horizontal panel 7 may be provided with a plurality of recesses 71 so as to accommodate and to hold the articles arranged therein. Furthermore, as shown in FIG. 2, each panel 7 may be provided with a plate 9 produced, for example, from transparent plastic material, one 9*a* of the ends of which is attached pivotably on the upper portion of each panel 7. This transparent plate 9 is able to pivot between an open position, allowing an article to be placed in the corresponding recess 71 or to be removed from said recess 71, and a closed position allowing all the articles arranged on one and the same panel 7 to be covered, while enabling them to be seen.

Furthermore, each upward-inclined or horizontal panel 8 arranged directly opposite a first panel 7 is provided with a reflective surface 8*a*. The reflective surface 8*a* of a given second panel 8 thus enables a person facing the front face 5 of the vertical board directly to observe the image or the reflection of the articles attached to the first panel 7 directly below and adjacent.

This reflective surface 8*a* may be formed by a coating, such as stainless steel, or any other reflective coating attached to each second panel 8. This reflective surface 8*a* may also be formed by a mirror extending over the entire surface of each second panel 8. Furthermore, the first panels 7 may also be partially provided with a reflective surface. The front face 5 of the vertical board may also be partially provided with first and second panels 7 and 8, for example on the upper portion, thus leaving the lower portion in the form of a planar, vertical surface that may or may not be provided with a reflective surface.

In the example shown in FIG. 1, the entire front face 5 of the vertical board is provided with downward-inclined or horizontal panels 7 and upward-inclined or horizontal panels 8. It is also possible for the first and second panels 7 and 8 to be arranged vertically such that the lateral edges 6 form the upper and lower ends of the vertical board 1.

The invention claimed is:

1. A vertical display stand for articles such as cosmetic products, comprising: a vertical board that has a rear face and a front face, said front face formed at least partially by a plurality of non-transparent first reflective panels and a plurality of second reflective panels inclined relative to the first panels, the first and second reflective panels being unitary with the board, wherein said first and second reflective panels are superposed vertically in alternance thereby defining together reliefs substantially in the form of crests, wherein each first reflective panel is inclined downward and forward and includes a plurality of recesses in which the articles are designed to be arranged, and wherein each second reflective panel is arranged opposite one of the first panels and is facing slantwise forward and upward from the corresponding first panel, such that a person facing the board can observe only a top portion of said articles, either directly, beside an image of said person reflected without obstacle on the first reflective panel, or indirectly, by reflection of said top portion of said articles on the second panel placed opposite said first panel, beside an image of said person reflected without obstacle on the second reflective panel.

2. The display stand as claimed in claim 1, wherein the first and second reflective panels extend over the entire width of the stand.

3. The display stand as claimed in claim 1, wherein a transparent plate is attached pivotably to each first reflective panel to enable the articles arranged in the plurality of recesses to be covered.

4. The display stand as claimed in claim 1, wherein said first and second reflective panels are mirror panels.

* * * * *